United States Patent [19]

Chambley et al.

[11] 4,186,549

[45] Feb. 5, 1980

[54] PACKAGING OF SELF-TWIST YARNS

[75] Inventors: Phillip W. Chambley; Alan H. Norris, both of Rome, Ga.

[73] Assignee: WWG Industries, Inc., Rome, Ga.

[21] Appl. No.: 910,463

[22] Filed: May 30, 1978

[51] Int. Cl.[2] ..... D02G 3/28; D01H 5/28; D01H 7/92

[52] U.S. Cl. ..... 57/293; 57/352; 242/43 R; 242/54.4

[58] Field of Search ..... 57/106, 293, 294, 352; 242/43, 43.2, 45, 54.4

[56] References Cited

U.S. PATENT DOCUMENTS

| | | | |
|---|---|---|---|
| 2,600,037 | 6/1952 | West | 242/54.4 |
| 3,807,159 | 4/1974 | Hamel | 57/106 Y |
| 3,994,448 | 11/1976 | Hembel | 242/54.4 |
| 4,112,662 | 9/1978 | Lappage et al. | 57/293 |

*Primary Examiner*—John Petrakes

*Attorney, Agent, or Firm*—Beveridge, DeGrandi, Kline and Lunsford

[57] ABSTRACT

Self-twisted yarn is packaged on a take-up device to prevent loss or modification of the twist previously imparted to the yarn by maintaining the yarn in a substantially rotation-free state as it is guided onto the take-up device. This is accomplished by wrapping the yarn around an elongated guide rod as it is fed to the take-up device under tension or by controlling the tensioned free length of the yarn as it is guided onto the take-up device to preclude rotation of the nodes or points of twist reversal in the yarn.

7 Claims, 6 Drawing Figures

Fig. 1.
(PRIOR ART)
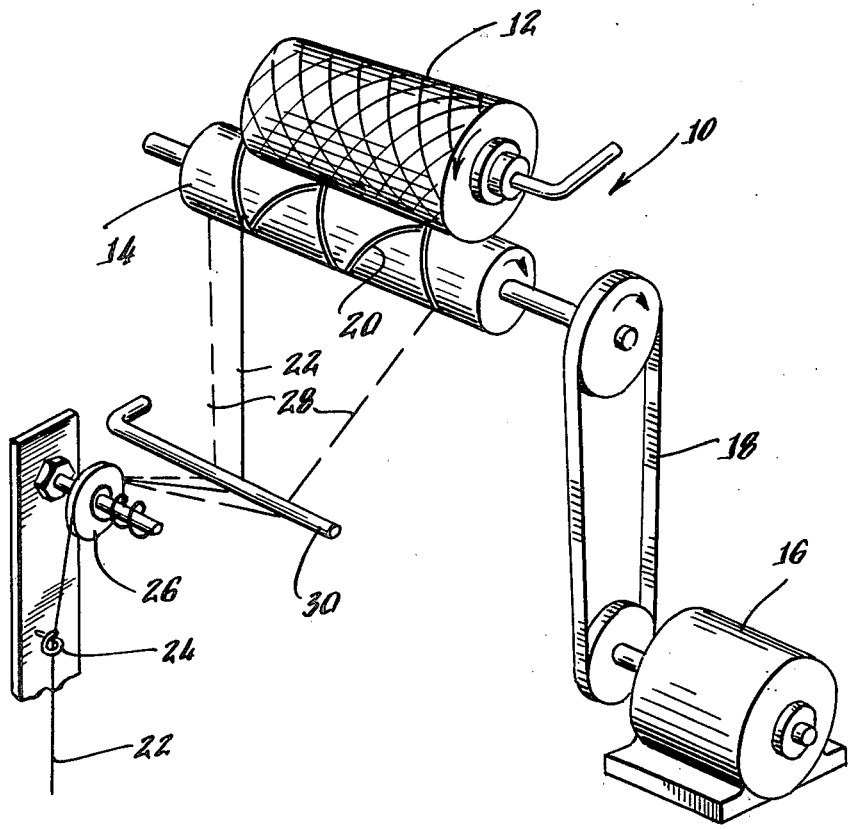
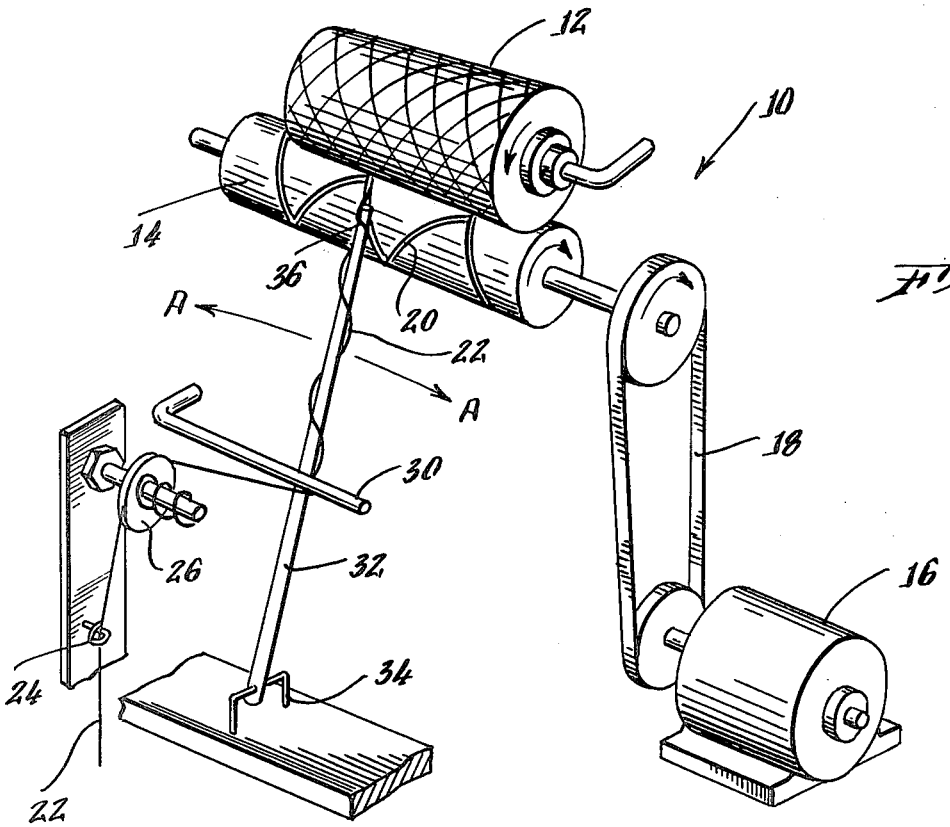
Fig. 2.

PACKAGING OF SELF-TWIST YARNS

BACKGROUND OF THE INVENTION

1. Field of the Invention

This invention relates to an improved process and apparatus for packaging yarn of the self-twist type.

2. Description of the Prior Art

In the manufacture of yarn, particularly yarn from synthetic fibers, there have been substantial developments in the area of false-twist and self-twist yarns because of various production advantages which can be realized using these techniques, and because such processes provide a shortened manufacturing route to a finished yarn product, and are therefore more economical as compared with conventional spinning and twisting processes.

As used herein, the term "false-twist" refers to a yarn in which a yarn strand is twisted to have alternate lengths of opposite direction twist with the sections joining the twisted sections having zero twist, which point will be referred to as a "node". The directions of twist are referred to as "S-twist" and "Z-twist", the appropriate letter being employed for twists in which the helices in twisted strands correspond with the middle portion of the appropriate letter.

The term "self-twist" is applied to yarns wherein two or more false twisted strands are brought together and permitted to ply therselves. The approximately equal torsional force of the same direction is stored in a pair or more of single yarns which are later brought into contact. Torque is released, permitting the single yarns to untwist, and in so doing, wrap around each other, forming a plied yarn. This plied yarn is especially suitable for carpet manufacture, because of the wide use of ply yarns in this industry for the carpet face yarn, and the economy of this manufacturing process.

However, self-twist yarns are extremely sensitive to tensional stress encountered in conventional winding operations, which are sufficient to cause gross changes in the yarn properties.

When a plied yarn is twisted, the singles yarns are forced into a helical path around one another, thereby shortening the length of the plied yarn strand. Tensional stress on plied yarn tends to straighten the helical path of the singles components, causing a torsional force to be developed in a direction counter to the singles helix in the ply strand. On conventionally processed yarns, the effect of this tension-induced helical torque is negligible, since the twist is uni-directional and the yarn cannot rotate to lose turns. In the case of a self-twisted yarn structure, however, a severe change in yarn twist occurs because sections of yarn on either side of a node have opposite helical torque when tensioned and the node rotates causing simultaneous loss of ply twist and increase of singles twist.

In order to use self-twist yarn, e.g., in a tufting machine creel, it must first be wound onto a cone or other suitable package. Tension on the threadline is essential to winding, as it contributes to proper package formation required to withdraw the yarn from the package in use, without sloughing or tangling. ("Sloughing" means that the take-off end pulls loosely wound adjacent wraps off the cone, resulting in a tangle.)

In carpet yarn systems, winding tensions may range from 100–300 gms. Lighter yarn counts for other end uses are wound at lower tensions, but it is also a fact that twist modification occurs at a lower level of tension on a finer yarn. This is because the helical torques discussed above are a function of yarn size (diameter of twisted member) so the twist-de-twist phenomena follow the same yarn size: twist: tension curves. In short, winding tensions cause a dramatic and deleterious change in ply/singles twist ratios in self-twist yarns.

This change in twist ratio tends to be made permanent in practice, since the yarn is placed on the cone in a tensioned and, therefore, elongated and de-twisted state. The cone may be stored for days or weeks prior to use, during which time the yarn is stress-relieved into its new and improper twist configuration.

This invention provides an apparatus and method for winding self-twist yarns into a reusable package, without loss or modification of the twist previously imparted to the yarn.

SUMMARY OF THE INVENTION

In accordance with the invention, as the self-twist yarn is wound onto a package, under tensional stress, means are provided for preventing rotation of the yarn and the concurrent loss or modification of twist in the yarn.

In one form of the invention, the yarn is wrapped around a guide rod flexibly mounted at its lower end so as to traverse the package as the yarn is wound on the package. The guide rod substantially precludes rotation of the yarn under the winding tension and serves simultaneously as a tension multiplier. The guide rod can follow the traverse of the yarn relative to the package in a grooved roller or can be independently driven to traverse the package.

Alternatively, the length of free yarn wound on the package at high tension can be reduced or minimized so as to prevent rotation and de-twisting of the yarn by a yarn guide and tension device immediately adjacent to the take-up package. The yarn guide may be reciprocably mounted to traverse the axis of the take-up package as the yarn is wound thereabout.

BRIEF DESCRIPTION OF THE DRAWINGS

Further objects and advantages of the invention will become apparent from the following description and claims, and from the accompanying drawings, wherein:

FIG. 1 is a schematic perspective view of a conventional drum traverse yarn winding apparatus;

FIG. 2 is a schematic perspective view of a yarn winding apparatus of the present invention;

DETAILED DESCRIPTION OF THE PREFERRED EMBODIMENT

Figure 4:
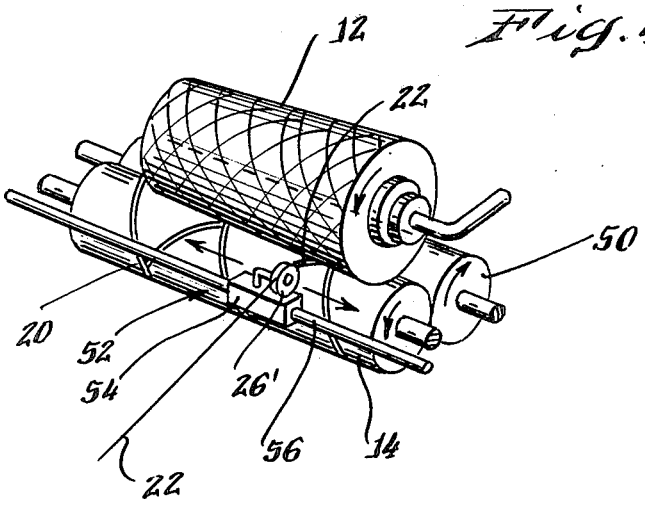
FIG. 4 is a schematic perspective view of still another modified form of the yarn winding apparatus of the present invention.

Referring now to the drawings in detail, wherein like numerals indicate like elements throughout the several views, FIG. 1 illustrates a conventional drum traverse winder 10. A yarn take-up cone 12 rests on grooved drum 14 which is driven by a motor 16 and belt 18. The groove 20 in the drum 14 is a continuous slot which reverses its direction of travel near the ends of the drum. A self-twisted yarn strand 22 fits into and travels along the groove as the drum turns, causing the yarn to be traversed the length of the take-up cone or package 12 back and forth as it is wound onto the cone. A ring guide 24 guides yarn 22 over tension discs 26, which provide necessary tension on the threadline so the yarn is wound firmly onto the cone. As the yarn is traversed by the drum, the threadline traverses the distance indicated by the broken lines 28. Direction change rod 30 is provided between tension disc 26 and drum 14 to adjust the depth into the groove taken by the yarn 22. Too little groove depth inhibits positive traverse, as does too little threadline tension.

It can be seen that, in the region between the tensioning disc 26 and the point at which the self-twist yarn contacts the cone surface, the yarn is under tension and will rotate at the nodes, thereby losing ply twist and increasing singles twist; it is thus wound on the cone package 12 in a modified twist condition. This results in:

(a) loss of ply twist;
(b) increase in singles twist;
(c) highly variable twist, since threadline tension is higher when yarn is going from mid-point to traverse extreme than from traverse extreme to mid-point;
(d) destruction of any previous heat setting benefits since, under tension, the fibers are dis-arrayed are re-positioned against one another in the yarn matrix, so that the heat-set fiber helices are no longer nested together; and
(e) stress relief of the yarn on a stored cone tends to set the yarn in its new and incorrect twist configuration.

Referring now to FIG. 2, a guide rod 32 is added to the winder 10. The guide rod is pivotably mounted at its lower end to an inverted U-shaped bracket 34 to permit sidewise motion, as indicated by the arrows A. A guide opening 36 is provided at the upper end, through which the yarn 22 passes enroute to the cone 12. Yarn in the traverse zone is wrapped one or more times around the traversing guide rod 32, which pivots in a direction following the yarn 22 as it traverses groove 20.

As yarn 22 is wound onto the cone and is traversed back and forth from one end of the cone 12 to the other, the guide rod 32 follows the traverse, owing to the flexible connection at its lower end to bracket 34.

The guide rod 32 is simultaneously a tension multiplier (because of the yarn wraps) and a means for preventing rotation of the yarn and concurrent loss of twist, since there is positive lengthwise contact between the tensioned yarn and the guide rod. Tension to build a proper package is adjustable by the tension disc 26 but the yarn between the tension disc 26 and the guide rod 32 is at a much reduced tension, since the wraps on the rod multiply the initial tension, in a rotation-free state, thereby further protecting the twist in the yarn.

For example, if, on a particular yarn, a tension of 150 grams was needed to build a satisfactory cone package, virtually all of this tension would be applied by the tension disc 26 in a conventional winder. The entire length of yarn between the tension disc 26 and the cone 12 would be under a tension of 150 grams, and twist modification would result since the yarn nodes are in free space on the way to the cone and will rotate to reduce ply twist.

By using a guide rod 32 with three yarn wraps, a tension multiplication factor of $1e^{\mu\alpha}$ is introduced on the yarn, where 1e is the Napierian logarithmic base (2.718), $\mu$ is the coefficient of friction, and $\alpha$ is the total wrap angle in radians. The multiplication factor of $$2.718^{(.2 \times 18.84)} = 43.4$$

was calculated for the rod 32 of FIG. 2. This means that for 150 grams tension at the cone, the tension disc 26 need apply only 150 ÷43.4 or 3.5 grams, well below the tension levels where twist changes would occur. The yarn is subject to 150 grams tension between the end of the guide rod 32 and the cone 12, but this is over a very short distance (e.g., 1½ inches), so that the time that a node is free to turn is consequently very short.

The following table illustrates ply twist measurements with and without the rod 32. Measurements are in turns per inch, taken over ten inch lengths on self-twist yarn produced according to the disclosure in U.S. Pat. No. 4,074,511, assigned to the assignee of this invention:

| TURNS PER INCH | | | |
|---|---|---|---|
| Before Winding | Wound without guide rod | Wound with guide rod | |
| | | 3 wraps | 4 wraps |
| 2.3 | 2.2 | 2.5 | 2.3 |
| 2.5 | 2.4 | 2.3 | 2.8 |
| 2.5 | 1.4 | 2.2 | 2.4 |
| 2.4 | 2.2 | 2.2 | 2.1 |
| 2.7 | 1.7 | 2.4 | 2.4 |
| 2.5 | 1.0 | 2.4 | 2.5 |
| 2.6 | 1.9 | 2.3 | 2.2 |
| 2.5 | 1.1 | 2.0 | 2.1 |
| 2.5 | 1.7 | 2.4 | 2.4 |
| 2.5 | 1.1 | 2.0 | 2.2 |
| 2.50 | 1.67 | 2.27 | 2.34 |

This data shows that one-third of the ply twist was lost in conventional winding, but the yarn retained 92 percent of its original ply twist when wound with the guide rod 32.

It should be understood that a more profound change occurs in the ratio of singles/ply twist than might be indicated by the foregoing table. Since the nodes are locked, each turn of ply twist lost is added to the singles twist. Assuming a realistic figure of 4.5 turns in the singles yarn before winding, the twist ratio in the previous example becomes:

| | Ratio, S/P | Cv %, Ply Twist |
|---|---|---|
| Before winding | 1.80 | 4.0 |
| Wound w/o rod | 3.19 | 28.7 |
| With 3 wraps on rod | 2.08 | 7.1 |
| With 4 wraps on rod | 1.99 | 9.1 |

It is also apparent that self twist yarn wound conventionally (without using guide rod) has more variable twist, as shown by the statistically derived coefficients of variation.

Figure 3:
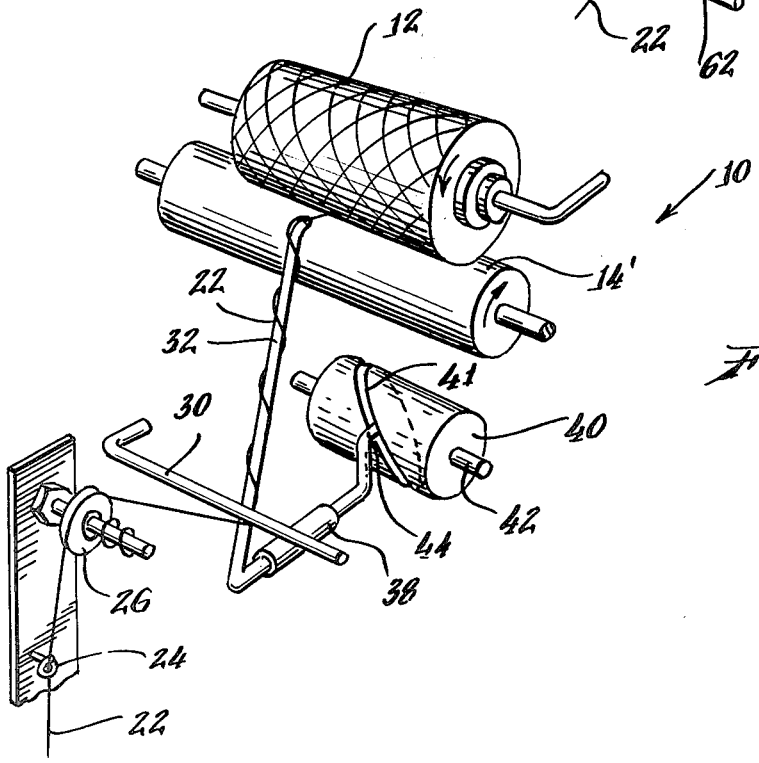
FIG. 3 is a schematic perspective view of a modified form of the yarn winding apparatus of the present invention.

In lieu of the guide rod 32 making its traverse of cone 12 by following the yarn in groove 20 of drum 14, the guide rod may be independently driven, thereby eliminating the groove 20. As shown in FIG. 3, the cone 12 is surface driven by a smooth drum 14'. Guide rod 32 is mounted so as to pivot in a bearing 38, and the guide rod is forced into reciprocal motion by the action of a cam 40 mounted on a rotating shaft 42. Cam 40 has an oblique groove 41 which is in rotating engagement with a bent end 44 of guide rod 32, which rotates in bearing 38. Tension device 26 can be disc, roller or flat plate.

Although the longitudinal contact between the guide rod 32 and the yarn 22 serves to prevent node rotation, another major factor is that the length of free yarn at high tension is held to a very short distance. This lends itself to other winding configurations.

The first of these is illustrated in FIG. 4. Yarn cone 12 is in contact with and is driven by a drum 50. A yarn guiding device 52 comprising a bracket 54 is slidably mounted on a guide bar 56. Bracket 54 has a protrusion (not shown) which fits inside the groove 20 of the driven traverse drum 14, so that as the grooved drum 14 is turned, the bracket 54 is traversed parallel to the cone axis. The bracket 54 has a combination yarn guide and tension disc 26 mounted on its top, with which the tension required to form the package is applied. The distance between the disc 26 and the nip of the cone 12 is very short to minimize twist disturbance in the yarn 22 going directly on the cone from the disc 26.

Figure 5:
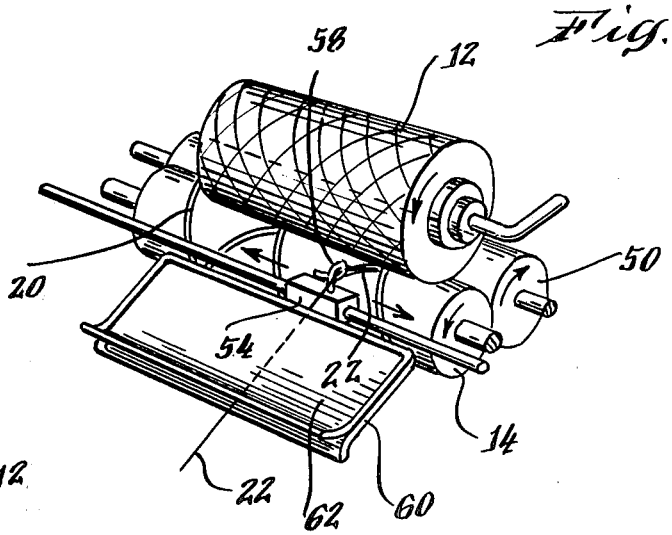
FIG. 5 is a schematic perspective view of yet another embodiment of the yarn winding apparatus of the present invention and FIG. 6 is a schematic perspective view of a further form of the invention in which the yarn is tensioned by a set of offset rods.

A similar arrangement is depicted in FIG. 5. In this embodiment, the traverse bracket 54 is only a guide having an eyelet 58 on its top receiving yarn 22 therethrough prior to its winding on cone 12. Winding tension is applied by passing the yarn 22 between a flat plate 60 and an adjustable leaf spring 62. The tension device, i.e., the plate 60 and leaf spring 62, is positioned so as to minimize the length of free yarn under tension to minimize twist disturbance in the yarn.

Figure 6:
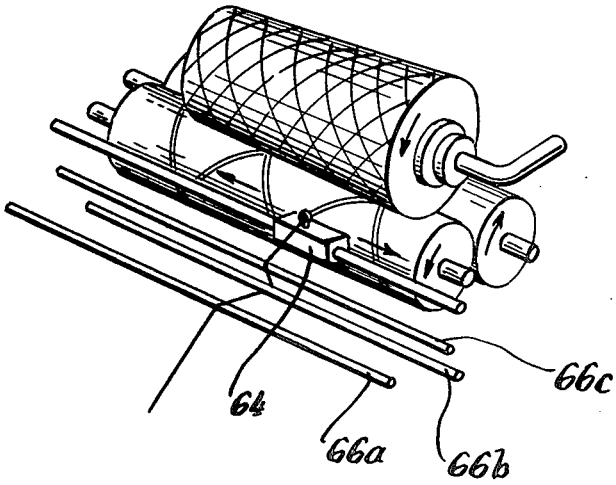

FIG. 6 illustrates still another embodiment of the invention. In this embodiment, a yarn guiding device 64 is used which is similar to the device used in the embodiment described with reference to FIG. 5. Instead of using a flat plate 60 and an adjustable leaf spring 62 to establish winding tension, however, a series of offset rods 66*a*, 66*b*, and 66*c* are interposed between the initial tensioning device (not shown) and the yarn guiding device 64. As the yarn travels through the serpentine path defined by the rods, the friction between the yarn and the rods multiplies the yarn tension to prevent twist modification. Rod 66*c* should be located as close as practical to the guide 64 to minimize the free length of yarn subject to the full winding tension.

While a series of offset rods are shown in FIG. 6, it is obvious that other means for guiding the yarn through a serpentine path on its way to yarn guiding device 64 might also be employed. For example, curved tubing might be used.

In the foregoing description, initial tension is established by a tensioning disc 26. Other types of conventional tensioning devices, such as weighted flat plates, magnetic grippers and the like, might readily be used to establish initial yarn tension. In addition to preserving yarn twist during take-up by preventing node rotation, apparatus constructed in accordance with the present invention also prevents twist modification occurring in the prior art devices due to tension changes at the traverse extremes. In those prior art devices, yarn tension is momentarily lost when the yarn reaches the limits of movement in the grooved drum and begins to move in the opposite direction. In apparatus constructed in accordance with the present invention, only a very short length of yarn (that between the take-up cone and the traversing yarn guide) is affected by this loss of tension and relatively little effect on twist occurs.

What is claimed is:

1. In an apparatus for packaging a self-twist yarn strand having nodes of zero twist along its length and opposite twist on either side of each node, said apparatus being provided with means for feeding said self-twist yarn strand onto a take-up device, said feed means including guide means located adjacent to the surface of said take-up device to guide the strand along the surface of said take-up device, and tension-applying means for applying tension to said strand as it is guided along the surface of said device, rotation-minimizing means located between the tension-applying means and the take-up device for minimizing rotation of the nodes of said yarn strand and concurrent loss of twist in said yarn strand as it is guided onto said take-up device, said rotation-minimizing means including an elongated guide rod between said tension applying means and take-up device about which said yarn strand is wrapped.

2. In an apparatus in accordance with claim 1 wherein said guide means includes a driven, helically grooved cylindrical drum located adjacent to the surface of said take-up device, said cylindrical drum receiving said yarn strand in the groove therein.

3. In an apparatus in accordance with claim 2 wherein said guide rod is freely pivoted to enable it to conform to the changing path of the yarn between said tension-applying means and said cylindrical drum.

4. A method of packaging a self-twist yarn strand having nodes of zero twist along its length and opposite twist on either side of each node, comprising, feeding said yarn along a path from a yarn supply to a take-up device, moving the yarn between tension discs to apply lateral pressure to the yarn at a given point on said path to increase the tension in the yarn between said given point and the take-up device, moving said yarn from said given point to said take-up device on an elongated rod which extends from the given point to the take-up device, said yarn being wrapped around and frictionally engaged with the rod to deter rotation of the yarn under winding tension and to multiply the initial tension in the yarn in a rotation-free state.

5. In an apparatus for packaging a self-twist yarn strand having nodes of zero twist along its length and opposite twist on either side of each node, said apparatus being provided with means for feeding said self-twist yarn strand onto a take-up device, said feed means including a disc receiving said yarn strand for guiding said strand along the surface of said take-up device and applying tension to said strand as it is guided along the surface of said device, means for minimizing rotation of the nodes of said yarn strand and concurrent loss of twist in said yarn strand as it is guided onto said take-up device, said means for minimizing rotation including a rod adjacent said take-up device extending substantially parallel to the longitudinal axis of said take-up device, bracket means supporting said disc and reciprocally slidable along said rod, cam means operatively connected to said bracket means for reciprocating said bracket means along said rod.

6. In an apparatus for packaging a self-twist yarn strand having nodes of zero twist along its length and opposite twist on either side of each node, said apparatus being provided with means for feeding said self-twist yarn strand onto a take-up device, said feed means including guide means for guiding said strand along the surface of said take-up device, means for applying tension to said strand as it is guided along the surface of the device, and means for minimizing rotation of the nodes of said strand and concurrent loss or twist in said yarn strand as it is guided onto said take-up device, said guide means and means for minimizing rotation including a rod adjacent said take-up device extending substantially parallel to the longitudinal axis of said take-up device, bracket means reciprocally slidable along said rod, cam means operatively connected to said bracket means for reciprocating said bracket means along said rod, and an eyelet on top of said bracket means receiving said yarn strand therethrough, said tension applying means including a flat plate and leaf spring located upstream from said bracket means for receiving said yarn strand therebetween.

7. In an apparatus for packaging a self-twist yarn strand having nodes of zero twist along its length and opposite twist on either side of each node, said apparatus being provided with means for feeding said self-twist yarn strand onto a take-up device, said feed means including means for guiding said strand along the surface of said take-up device, means for applying tension to said strand as it is guided along the surface of said device, and means for minimizing rotation of the nodes of said yarn strand and concurrent loss of twist in said yarn strand as it is guided onto said take-up device, said means for minimizing rotation including a plurality of rods extending substantially parallel to the longitudinal axis of said take-up device, said rods being offset relative to each other to define a serpentine path for said strand.

* * * * *